US006207228B1

(12) United States Patent
Hundt et al.

(10) Patent No.: US 6,207,228 B1
(45) Date of Patent: Mar. 27, 2001

(54) CONCURRENT FRAGMENTATION AND IMPREGNATION MACHINE AND PROCESSING

(76) Inventors: Vincent G. Hundt, N591 CO PI, Coon Valley, WI (US) 54623; Frederick G. Peltz, Box 301, St. Martin, MN (US) 56376

( * ) Notice: Subject to any disclaimer, the term of this patent is extended or adjusted under 35 U.S.C. 154(b) by 0 days.

(21) Appl. No.: 09/294,282

(22) Filed: Apr. 19, 1999

Related U.S. Application Data

(60) Provisional application No. 60/082,481, filed on Apr. 21, 1998.

(51) Int. Cl.[7] ..... B05D 7/00

(52) U.S. Cl. ..... 427/213; 427/212; 427/424; 427/426; 118/303

(58) Field of Search ..... 427/212, 213, 427/424, 42 C; 47/9; 241/28, 21; 118/303

(56) References Cited

U.S. PATENT DOCUMENTS

| | | | | |
|---|---|---|---|---|
| 2,707,690 | * | 5/1955 | Pearson | 427/426 |
| 3,462,083 | * | 8/1969 | Kautz | 427/426 |
| 3,481,686 | * | 12/1969 | Ivnas et al. | 427/213 |
| 3,911,183 | * | 10/1975 | Hinkes | 427/213 |
| 4,542,041 | * | 9/1985 | McClellan et al. | 427/212 |
| 4,794,022 | * | 12/1988 | Johnson et al. | 427/212 |
| 5,077,128 | * | 12/1991 | Bernard et al. | 427/426 |
| 5,192,587 | * | 3/1993 | Rondy | 427/212 |
| 5,308,653 | * | 5/1994 | Rondy | 427/212 |
| 5,562,956 | * | 10/1996 | White, Jr. | 427/212 |
| 5,564,222 | * | 10/1996 | Brody | 43/124 |

OTHER PUBLICATIONS

Forest Products Journal, vol. 44, No. 9 (Feb. 1994).

Term–A–Rid 613, http://www.termarid.com/whatisit.html (Apr. 21, 1998).

* cited by examiner

*Primary Examiner*—Shrive Beck
*Assistant Examiner*—Paul D. Strain

(57) ABSTRACT

Impregnating agents are concurrently processed with bulky materials such as recycled wastes within a turbulent fragmenting zone in order to fragment and uniformity impregnate the fragmented materials with impregnating agents. Uniform distribution of the impregnating agents throughout the processed materials may be accomplished by using multiple injection lines which port into the fragmenting zone at a position so as impregnate fluidized particles. Application of the impregnating agent is maintained at a substantially uniform pressure (e.g. porting from a manifold) so as to uniformity disperse and impregnate the impregnating agents throughout the processing material. The dispersal of the impregnating agent is effectuated by concurrently suspending fragmenting and impregnating the materials within the fragmenting zone 7. Recycled waste materials may be effectively impregnated with a host of impregnating agents such as application of pesticides, colorants, binding agents, insecticides, herbicides, etc. by the process. The impregnating process is particularly effective for use in impregnating cellulosic materials with multiple impregnating agents or colorants furnished to the fragmenting zone from the multiple sources at controlled and monitored rates. Conventional waste recycling machines may be appropriately equipped with the impregnating accessory for use in the impregnating process.

20 Claims, 8 Drawing Sheets

CONCURRENT FRAGMENTATION AND IMPREGNATION MACHINE AND PROCESSING

This application claims the benefit of Provisional Application No. 60/082,481 bearing the same title as captioned above and filed Apr. 21, 1998.

FIELD OF THE INVENTION

The present invention relates to uniformly dispersing an additive within particulated materials, and more particularly to incorporating additives into recycled materials while suspending the materials in a particulating zone and apparatuses for the processing thereof.

BACKGROUND OF THE INVENTION

It is conventional to admix chemical additives with ground or particulated insoluble materials so as to disperse the additives throughout the particulated materials. Exemplary insoluble particulated materials to which it may be desirable to disperse or incorporate chemical additives include cellulosic materials such as wood and paper wastes. U.S. Pat. Nos. 5,192,587 and 5,308,653 to Rondy disclose methods of coloring comminuted woods by introducing colorants into comminuted woods augured through a flighted auger. If it were possible to uniformly disperse certain chemical additives effectively while particulating the wastes into a recycled particulated waste material or otherwise an usable by-product materials at an attractive processing cost, then the value, utility, and profit margins for such recycled waste products or by-product materials would be significantly enhanced.

Illustrative chemical additives which, if uniformly incorporated within comminuted or particulated materials, would enhance the materials' value include retardants such as fire retardants, pesticides, insecticides, herbicides, rodenticides, colorants or coloring reagents (e.g. such as dyes, pigments, etc.), flow agents, bulking agents and other similar type additives. These additives may be provided in a form which permits the chemical additives to be uniformly dispersed within a suitable vehicle or carrier. Such vehicles or carriers may function as a solvent for the chemical additive, or as an inert dispersant, or a vehicle for an insoluble chemical additive, or alternatively in cooperative association with suitable emulsifying agents as an emulsified carrier for the additives. Water is a particularly suitable vehicle or carrier for most chemical additives.

SUMMARY OF THE INVENTION

It is now feasible to uniformly disperse or incorporate chemical additives throughout a recycled mass of particulated materials such as cellulosic waste materials while concurrently converting the bulky wastes into recycled wastes of a desired particle size. In the impregnating method, a chemical or impregnating additive carried by a suitable vehicle or carrier is uniformly injected into the fragmenting zone and onto particulated waste material while the waste materials are suspended and being particulated to the desired size within the fragmenting zone. The turbulent fragmenting zone serves to uniformly and homogeneously distribute the chemical additive throughout the particulating or comminuting waste materials to provide a homogeneous mass of the recycled particulated waste impregnated with the impregnating chemical additive. The cooperative combination of uniformly injecting the additive into the turbulent particulating zone while impacting the processed product drives the chemical additive deeply into the porous intercies of the comminuted or particulated product.

The efficacy of the process in uniformly dispersing chemical additives throughout particulated cellulosic materials may be profoundly illustrated by the adaptation of the process to the coloring of paper or wood wastes with coloring agents. In contrast to conventional batch admixing techniques which frequently result in a non-uniform distribution of the coloring agent or blotched coloring such as by excessive colorant concentrations or the excessive use of a carrier (e.g. water), the present process yields intensely bright and uniformly colored particulated products with significantly less water and dye or colorant. The cooperative combination of fragmenting and impacting of the wastes in a turbulent fragmenting zone while suspending the wastes and uniformly injecting vehicle carried colorants into the turbulent fragmenting zone impregnates and uniformly embeds the colorant throughout the fragmented or comminuted particles. This deeply embeds the colorant within the porous intercies and upon the surfaces of the recycled waste particles. As a result, intensely bright and deeply colored impregnated products (e.g. wood chips, mulches, bedding, insulation, etc.) may be achieved through the use of this unique process. Because of the processing efficacy, significantly lower chemical additive concentrations may be effectively utilized to achieve significantly enhanced coloration or pigmentation of recycled products. Similarly, other chemical additives such as insecticides for termites, (e.g. for borates, boric acid, etc.) fire retardants (e.g. cellulosic insulation), binding agents, fillers, etc. may be uniformly dispensed at a reduced concentrations and unit costs without detracting from the product efficacy (e.g. insecticidal activity or fire retardency) of the processed product in many divergent forms (e.g. pressed wood fibers, insulation, etc.).

DETAILED DESCRIPTION OF THE INVENTION

Figure 1:
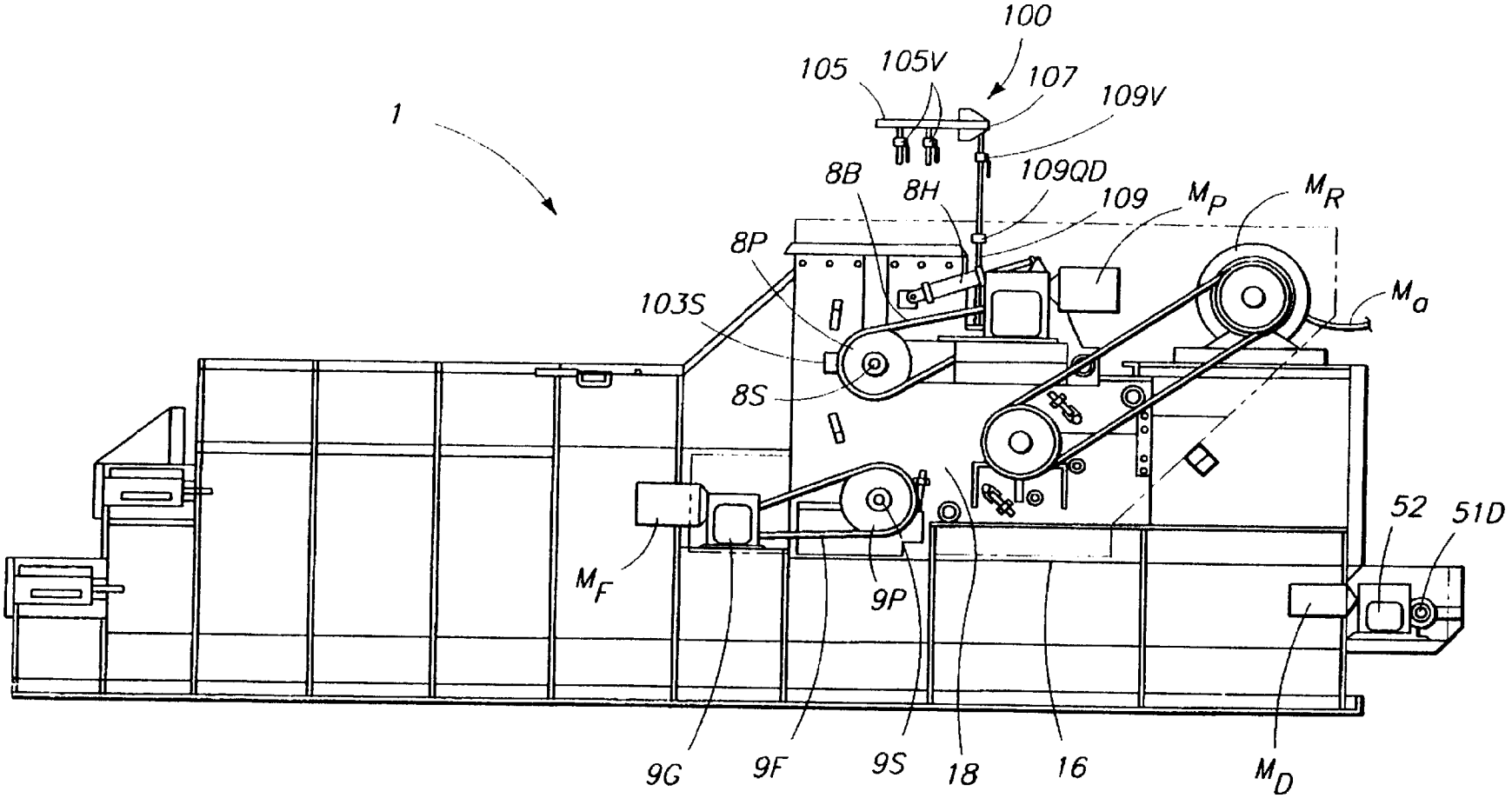
FIG. 1 depicts a side view of a suitable waste processing machine equipped with an impregnating accessory to uniformly impregnate particulated recycled materials with impregnating reagents.

With reference to the accompanying figures, there is provided a waste recycling impregnating machine (generally designated as 1) equipped with an impregnating accessory (generally designated by 100) for impregnating comminuted materials D with impregnating agents. FIG. 1 depicts an external view of a suitable waste recycling machine 1 fitted with the impregnating accessory 100 for impregnating materials therewith. The internal workings of the impregnating machine 1 shown in FIG. 1 is depicted more specifically by the cross-sectional view of FIG. 2.

Figure 2:
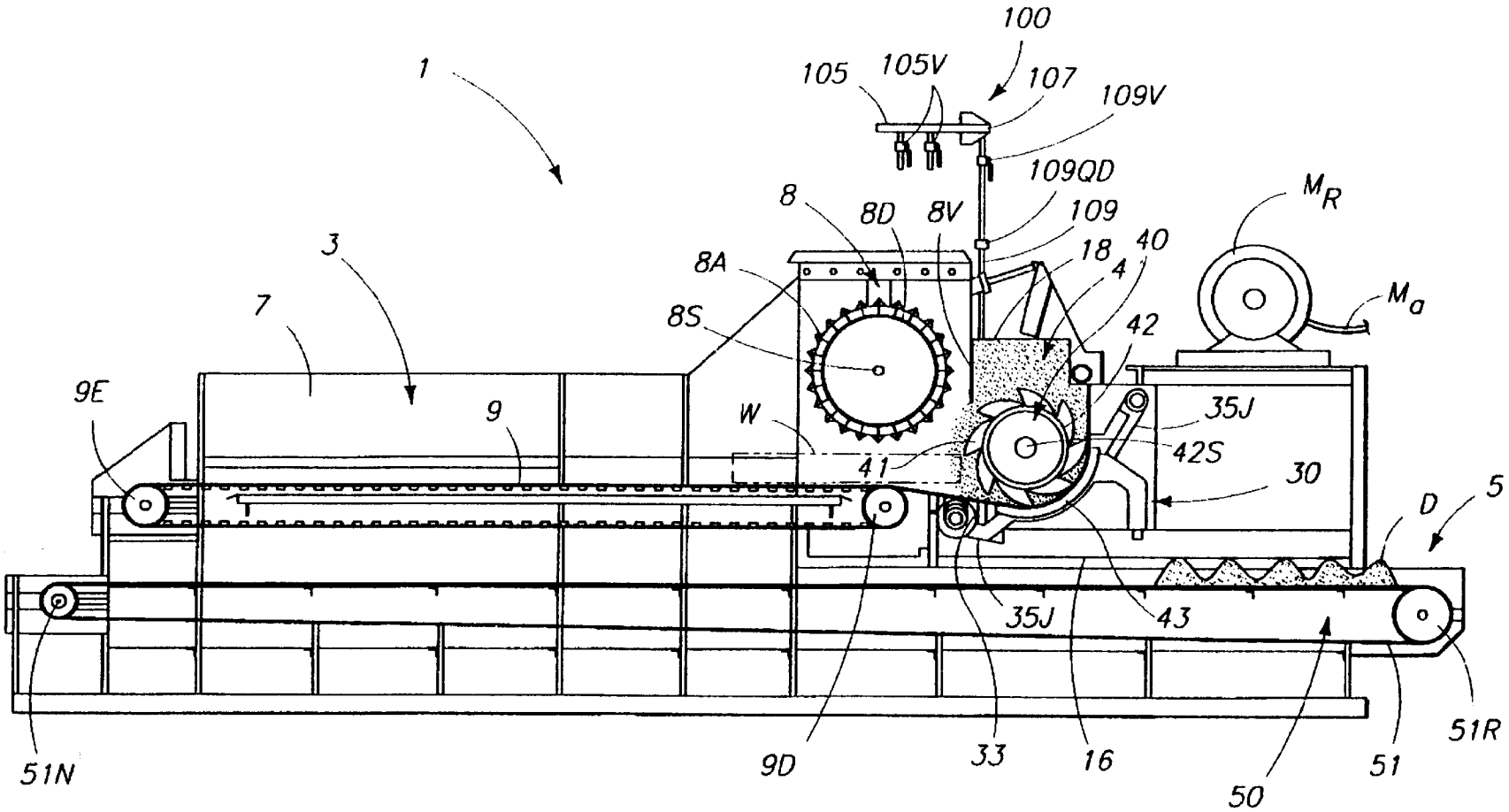
FIG. 2 is a bisecting cross-sectional view of FIG. 1.

The waste recycling machine 1 as depicted by FIGS. 1 and 2 appropriately includes a sturdy frame 16 structurally sufficient to withstand the vigorous mechanical workings of machine 1 and the attached impregnating accessory 100. Since machine 1 is designed to splinter and fragment wastes under tremendous impacting forces, machine 1 appropriately includes a sturdy protective plate metal shell 18. Although machine 1 may be powered by a variety of different power sources (e.g. internal combustion engines, diesel engines, hydraulic motors, industrial and tractor driven power take-off, etc.), the depicted machine 1 is shown as being powered by several electrical motors generally prefixed by M, namely $M_R$, $M_D$, $M_P$, and $M_F$. Electric motors $M_R$, $M_D$, $M_P$, and $M_F$ are equipped with suitable drive means for powering the various working components (namely the feeding, fragmenting and discharging means) of machine 1. In operational use, waste materials are fed to a fragmenting zone 4 by power feeding means (generally referenced as 3) powered by feed motor $M_F$ in cooperative association with power feed 8 powered by power feed motor $M_N$. A rotary motor $M_R$ serves as a power source for powering a fragmenting rotor (generally represented as 40) of the fragmenting means 4. A discharging motor $M_D$ serves as a power source for powering a discharging means (generally designated as 5) for conveying processed products D from machine 1.

The basic mechanical operation of the impregnating combination includes, in general, machine 1 equipped with feeding means 3 for feeding waste W, fragmenting 4 means for fragmenting or comminuting the waste W in the fragmenting zone 4 to a desired particle size of product D in cooperative association with injecting means (generally enumerated by a 100 series number) for uniformly injecting impregnating reagents into the fragmenting zone 4 and discharging means 5 for discharging the desired fragmented and impregnated product D from machine 1.

Suitable impacting and turbulent fragmenting machines 1 for use with the impregnating accessory may be advantageously equipped with a screen 41 so as to more effectively grate and screen the impregnated fragmented particles to an impregnated product D of the desired particle size. Commercially available waste recycling machines of this type include high capacity, turbulent impacting machines 1, such as ROTOCHOPPER® MC Series (e.g. MC-156, MC-166, etc.) and EC Series (e.g. EC-156, EC-166, EC-124, etc.) manufactured by Peltz Manufacturing, Inc., 217 West Street, St. Martin, Minn. 53676 and distributed by PCR, Inc., N591 CO PI, Coon Valley, Wis. 54623. The machine 1 includes impacting and shearing teeth 41 which rotate about cylindrical rotor 42 and exert a downwardly and radially outward, pulling and shearing action upon the waste material W as it is fed onto a striking bar 33 and sheared thereupon by the shearing teeth 41. The shearing teeth 41 project outwardly from a cylindrical rotor 42 which is typically operationally rotated at an operational speed of about 1800–2500 r.p.m. Rotor 42 is driven about a power shaft 42S which is in turn powered by a suitable power source such as motor $M_R$. The rotating teeth 41 create a turbulent flow of the fragmenting wastes W within the fragmenting zone 4. These turbulent fragmenting conditions create an exceptional processing site and environment for impregnating the wastes W with a suitable impregnating agent to produce the desired impregnated product D. Further information concerning waste recycling machines of this type may be obtained by referring to our co-pending patent application Ser. No. 08/908,470 filed on Aug. 6, 1997 and an operational manual entitled "MC Manual" for MC Series ROTOCHOPPER® all of which are incorporated herein by reference.

Fragmenting machines 1 of the aforementioned type effectively create a unique turbulent fragmenting zone 4 in which suspended waste materials W are concurrently impregnated and fragmented within the fragmenting zone 4 to the desired impregnated product D of a predetermined particle size. While the waste materials W are being particulated and turbulently suspended within the fragmenting zone 4, impregnating reagents or additives are most effectively injected (with or without a suitable vehicle or carrier) into the fragmenting zone 4, preferably at a controlled rate of application. The turbulent fragmenting zone 4, in cooperative association with impregnation accessory (generally designed as 100 series enumeration), uniformly and homogeneously distributes and impregnates the impregnating additives throughout the particulated processed material to provide a homogeneous mass of the processed materials D characterized as being substantially and uniformly impregnated with the impregnating additive.

A cross-sectional view of a suitable impregnating machine 1 for use in combination with impregnating accessory 100 as shown in FIG. 2 includes a feeding means (generally designated as 3) depicted in the form of a hopper 7 for receiving waste materials W (shown by phantom lines) and a continuous apron 9 or conveying belt for feeding wastes W to waste fragmenting zone 4. Apron 9 may be suitably constructed of rigid apron sections hinged together and continuously driven about drive pulley 9D and an idler pulley 9E disposed at an opposing end of apron 9. Apron 9 is typically operated at an apron speed of about 10 to about 30 feet per minute.

A power feeder (designated in general as 8) driven by motor $M_P$, in cooperative association with apron 9 driven by motor $M_F$, uniformly feeds and distributes bulk wastes W such as cellulosic source materials to fragmenting zone 4. Power feeder 8 positions and aligns the waste W for effective fragmentation by the fragmenting rotor 40. Power feeder 8 includes a drum 81D equipped with projecting feeding teeth 8A positioned for counterclockwise rotational movement about power drum 8D. Drum 8D is driven by power feed shaft 8S and drive sprocket 8P which in turn is driven by chain 8B, drive sprocket 8P and motor $M_P$. The feed depth, or clearance, of power feeder 8 may be optionally regulated by a hydraulic cylinder 8H powered by a suitable hydraulic fluid power source (not shown) fitted with a conventional hydraulic cylinder adjusting means for adjusting the power feeder 8 to the appropriate clearance for feeding wastes W. Hydraulic cylinders 8H may be typically preset to withstand a predetermined back pressure so as to permit power feeder 8 to float upon waste materials being fed to power feeder 8 by apron 9. The position of the power feeder 8 in relation to apron 9 generally depends upon the amount of waste material W at a site upon apron 9 immediately below power feeder 8. Power feeder 8 floats in synchronization with the material W fed upon apron 9 to fragmenting zone 4. Feed motor $M_F$ in cooperative association with gear box 9G, apron drive pulley 9P, chain 9F, and apron drive sprocket 9D driven about feed shaft 9S serves to drive continuous feed apron 9 about feed drive pulley 9D and feed roller pulley 9E. The travel rate or speed of apron 9 may be appropriately regulated through control of gear box 9G.

Figure 9:
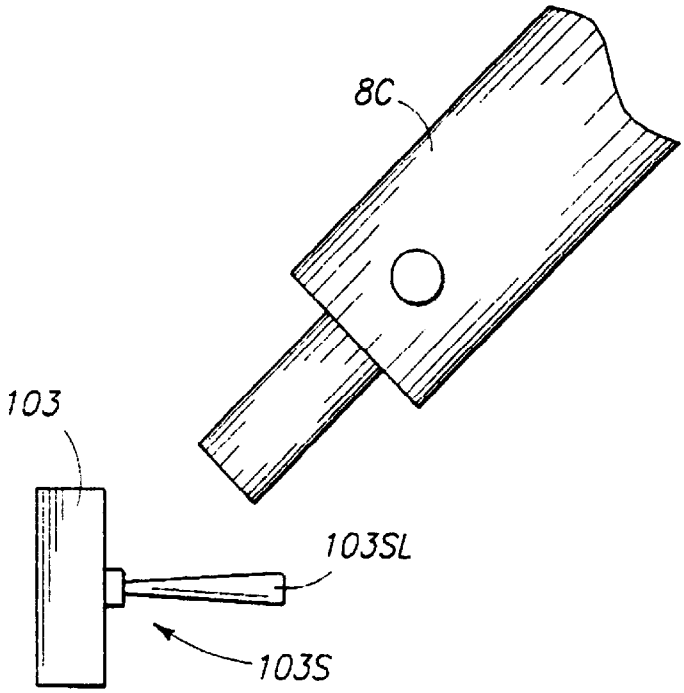
FIG. 9 illustrates a partial view of the switching system in the "off" position for the impregnation accessory.
Figure 10:
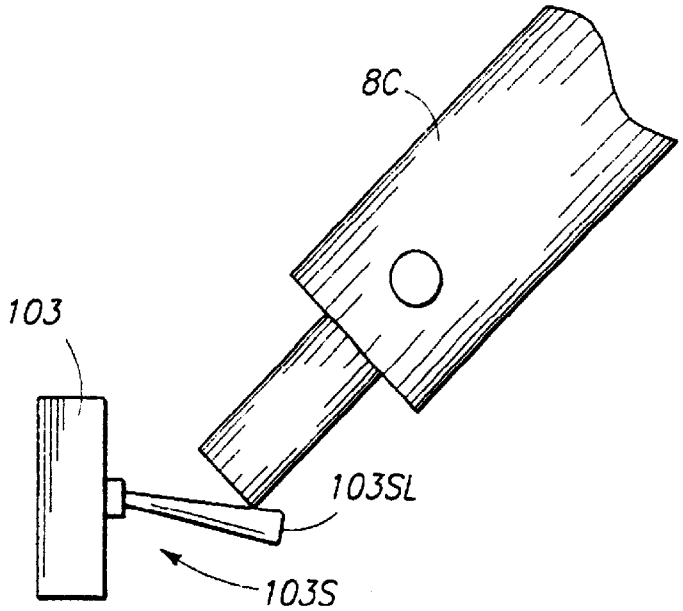
FIG. 10 illustrates the switching system of FIG. 9 shown at the "on" switching position.

Since power feeder 8 will elevate when wastes W become disposed between power drum 8D and feed apron 9, a contact switch 103S positionally fixed to frame 18 so as to operationally contact with power feeder 8 (when in use) may be effectively utilized to detect the load of waste materials W being fed to the fragmenting zone 4 and switch a monitored amount of the impregnating agent for effective injection into zone 4 and impregnation onto waste W. This may be as simple as using a rotor arm (not shown) for rotor 40 to switch through the use of contacting arm 8C as shown by FIGS. 9 and 10.

The cross-sectional view of FIG. 2 depicts in greater detail the cooperative operational relationship between feed apron 9, the power feeder 8, striking bar 33, the impacting teeth 41 of the rotor 42 and impregnating accessory 100 for injecting impregnating additives directly into impregnating zone 4. FIGS. 3–11 depict in greater detail the impregnating accessory 100 including a unique mounted manifold 107 equipped with impregnating lines 109 accessing into the fragmenting chamber 4 of machine 1. As illustrated, particularly in FIGS. 2 and 7, manifold 107 provides multiple impregnating feed lines 109 which feed impregnating agent directly into the fragmenting zone 4. Impregnating feed lines 109 are positioned above fragmenting chamber 4 in close proximity to the vertical dividing panel 8V which separates the power feeder 8 section from the fragmenting zone 4. Impregnating agents admitted to fragmenting zone 4 gravitationally fall onto waste materials W while the wastes W are being fragmented within fragmenting zone 4. The manifold 107 is capped at an end opposite from a manifold feed line 105 which feeds the impregnating agent to the manifold 107. Manifold 107 affords a substantially uniform spray pattern or injection of impregnating agent across the entire interfacing cross-sectional width of the fragmenting zone 4. Manifold 107 permits a uniform injection of impregnating agent at a substantially uniform application rate and pressure into the fragmenting zone 4.

Initial fragmentation and impregnation of the waste feed W is accomplished within the dynamics of a fragmenting zone 4 which includes a striking bar 33 and a cylindrical rotor 42 equipped with a dynamically balanced arrangement of breaker teeth 41. The striking bar 33 serves as a supportive anvil for shearing waste material W fed to the fragmenting zone 4. Teeth 41 are staggered upon rotor 42 and dynamically balanced. Rotor 42, when operated at an operational rotational speed of about 1800 r.p.m., rotates about shaft 42S in complete balance. Material fragmented by the impacting teeth 41 is then radially propelled along the curvature of the screen 43. The impregnating agents are typically carried by a dispersing vehicle through impregnating lines 109 for atomization onto the radially propelled materials at this processing stage which uniformity impregnates the processing wastes with the impregnating agent. Screen 43, in cooperation with the impacting teeth 41, serves to further fragment by grating the waste materials W upon the surface and screen of 43 refine the waste W into a desired particle screening size until ultimately fragmented to a sufficient particle size so as to screen through screen 43 for collection and discharge by discharging conveyor 51. These turbulent fragmenting conditions are ideal for uniformly dispersing and impregnating the impregnating agents throughout the processed product D. Throughout this turbulent flow and impacting of wastes, the impregnating agents are continuously introduced to the top of the fragmenting zone 4 by impregnating accessory 100 so as to gravitate onto the suspended fragmenting wastes which, within the turbulent and impacting conditions, effectively uniformly distributes and impregnates within the fragmented impregnated product D.

Shearing breaker teeth 41 impact against waste W supported by striker bar 33 or anvil. Teeth 41 exert a downwardly and radially outwardly pulling and shearing action upon waste material W resting upon the anvil 33. Teeth 41 are preferably positioned (in relationship to a vertical line intersecting the axial shaft 42S of the rotating cylinder 42 assigned a value of 0 degrees) so as to make initial contact upon the waste W at a radial arc ranging from about 26° to about 36° angle. The counterclockwise rotating cylindrical movement of rotor 42 equipped with tangential disposed removable breaker teeth 41 is preferably positioned from about a 64° angle to about a 76° angular relationship to the striker bar 33. The net effect of this arrangement results in a highly effective shearing or fragmentation of the waste materials W at the striking bar 33 site while effectively uniformily distributing and impregnating the wastes W with the impregnating agents under turbulent flow conditions.

The cross-sectional view of FIG. 2 depicts a machine equipped with a cradle assembly 30 and a shear releasing mechanism which allows cradled screen 43 and striking bar 33 to undamagingly break away from the fragmenting zone 4 when subjected to a damaging obstacle which creates a damaging force exceeding the threshold of shearability for the machine 1. The releasing mechanism for disengaging the cradle assembly 30 from the fragmenting position is shown in FIG. 2 in the engaged position. Disengagement to the disengaged position (not shown) is triggered by a shearing of a shear bolt in latching arms 37J which maintain cradle assembly 30 in an operative fragmenting position until a shearing force exerted by a high shear obstacle causes at least one or both latching arm shear bolts to shear.

The impregnated fragmented product D is screened by forcing product D through cradle screen 43 for collection by the discharging means 5. Discharging conveyor (generally designated by a 50 series number) extends lengthwise and widthwise along the entire bottom portion of the machine 1. Impregnating materials D fragmented to a particle size sufficient to pass through screen 43 gravitate onto discharging conveyor belt 51 which then transports the desired impregnated material D to a suitable collection point. Discharging conveyor 50 includes belt 51 driven by drive sprocket 51D about running pulley 51N all of which is powered by motor $M_D$ and conveyer gear box 52 for varying the speed of belt 51. Other discharging means 5 such as flighted augers, pneumatic conveyors, etc. may be used to discharge and collect the product D from the fragmenting zone 4.

Although the invention broadly applies to impregnation of a broad range of porous materials with a host of impregnating reagents, the efficacy of the machine and its use is particularly well-illustrated by its adaptation to the colorization of waste materials W and materials, particularly in the colorization of wastes W of a water-insoluble cellulosic material with coloring reagents. The extent by which the processed products D are intensely and uniformly colored reflects upon the processing efficacy of the impregnating process utilizing machine 1 in cooperative combination of the impregnating accessory 100. The cooperative combination of uniformly injecting and impregnating the impregnating agent onto the waste material W while the waste W is being dynamically processed within the impacting zone 4 produces superior impregnated particles D. The process involves impacting the impregnating reagent and particles together under turbulent conditions wherein the waste particles W are maintained in a fluidized state within the fragmenting zone 4. This results in driving the impregnating agent, such as a colorant, deeply into the porous intercies of cellulose product D to provide a rich and uniformily colored product D. The unique process is capable of yielding intensely and deeply colored particulated products D when applied to impregnating of waste or other cellulosic materials W with coloring reagents. Because of its processing efficacy, significantly lesser amounts of chemical impregnating reagents (i.e. colorant concentrations) and carrier agent or vehicle (e.g. water) may be utilized to effectively achieve significantly enhanced coloration or pigmentation of processed materials D.

Figure 3:
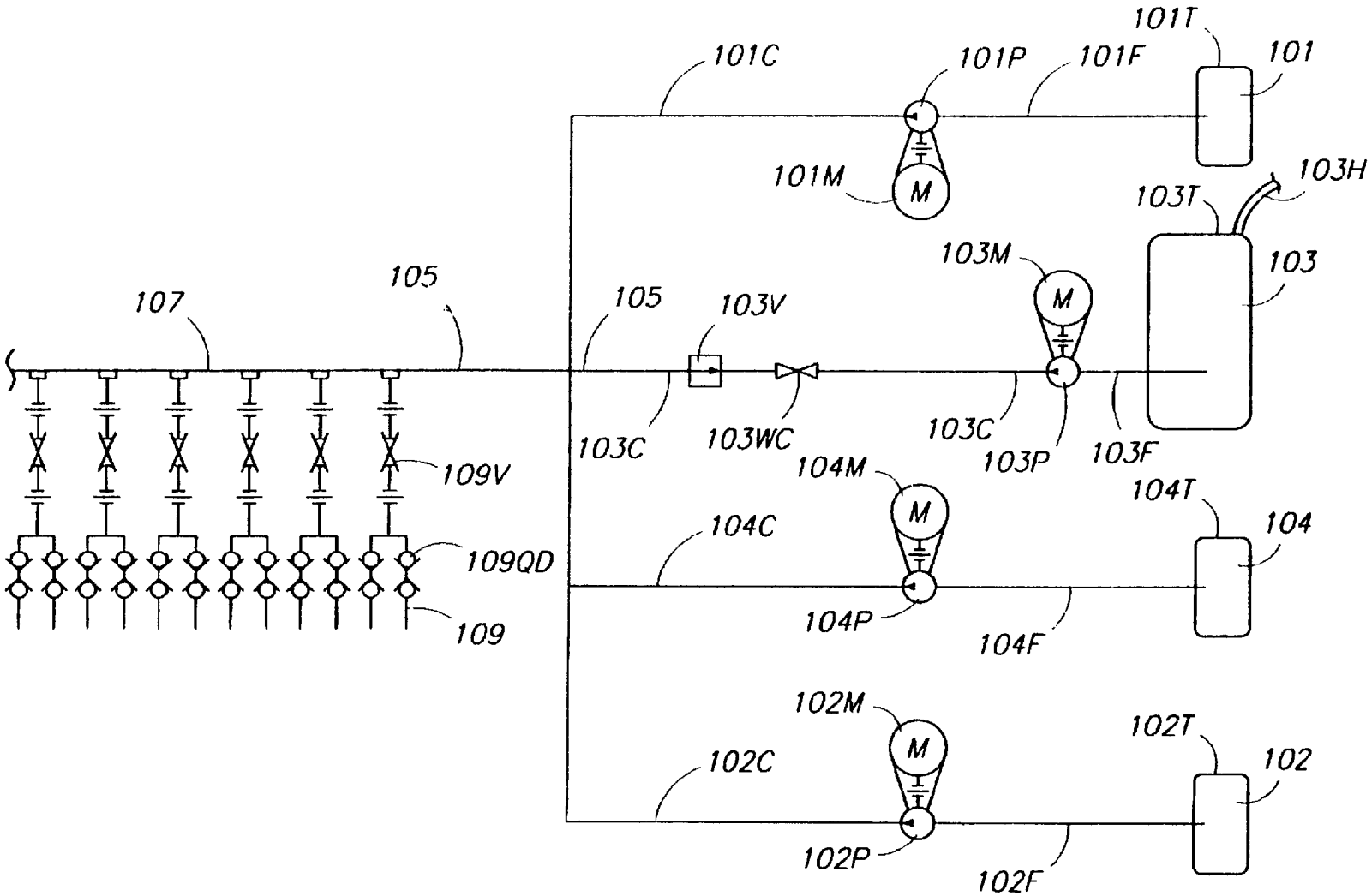
FIG. 3 is a schematic drawing showing an arrangement of component elements for use as an impregnating accessory with the recycling machine of FIGS. 1 and 2.
Figure 4:
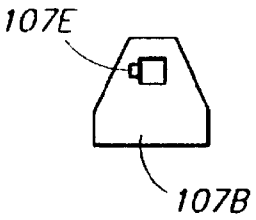
FIG. 4 is an isolated partial side view of the manifold shown in FIG. 7.
Figure 5:
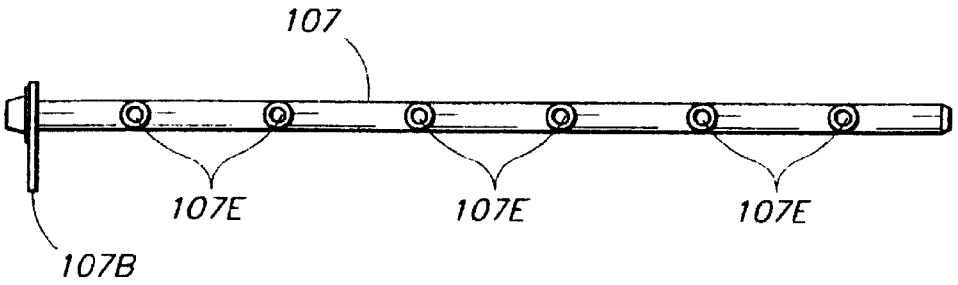
FIG. 5 is a side view of the manifold shown in FIG. 4.
Figure 6:
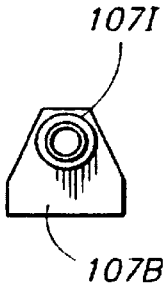
FIG. 6 is an opposite end view of the manifold shown in FIG. 4.
Figure 7:
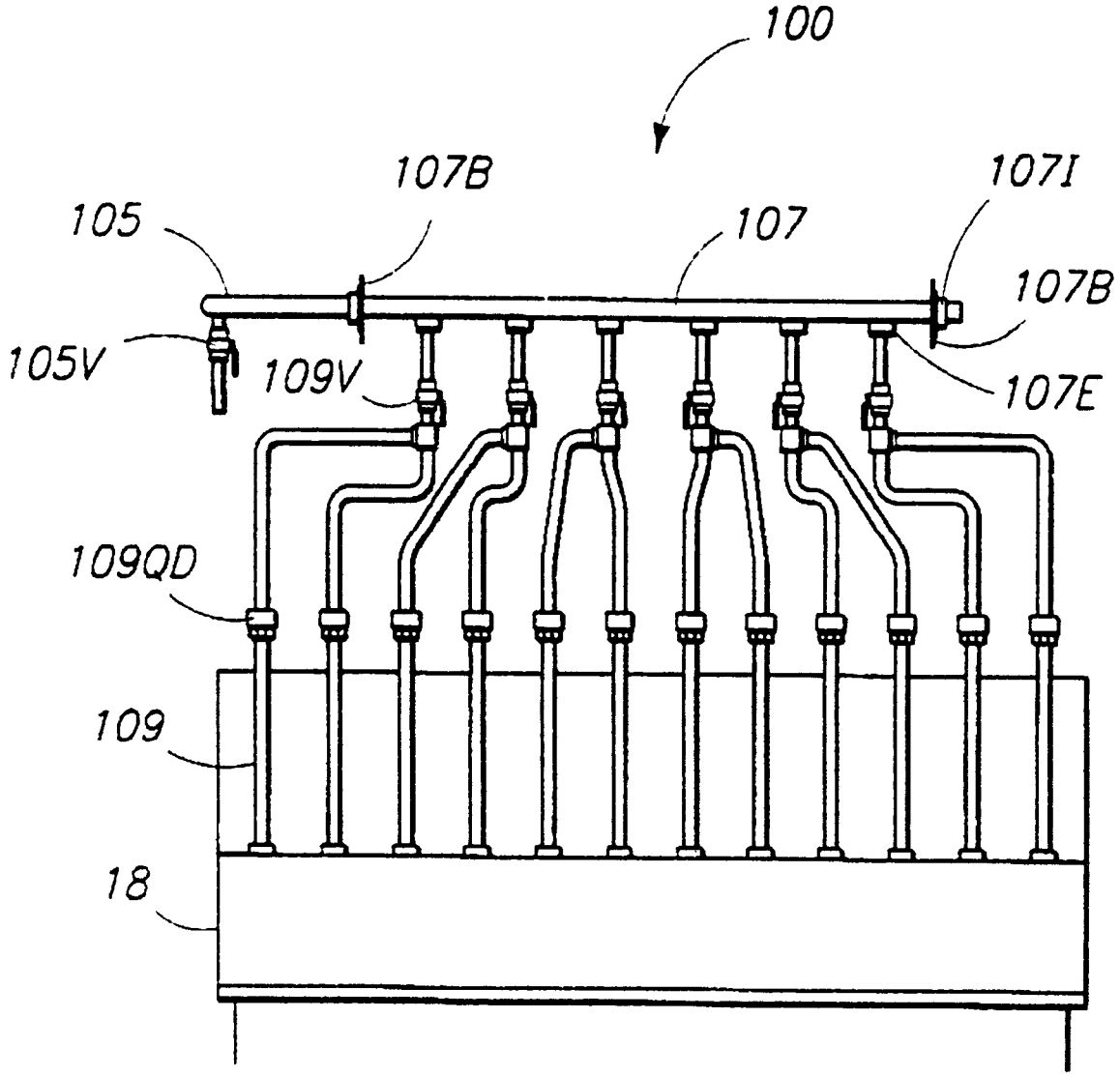
FIG. 7 is an elevational front view of the impregnating accessory shown in FIG. 1 which depicts in greater detail equipped with outlet ports for injecting impregnating agents to the recycling machine of FIG. 1.
Figure 8:
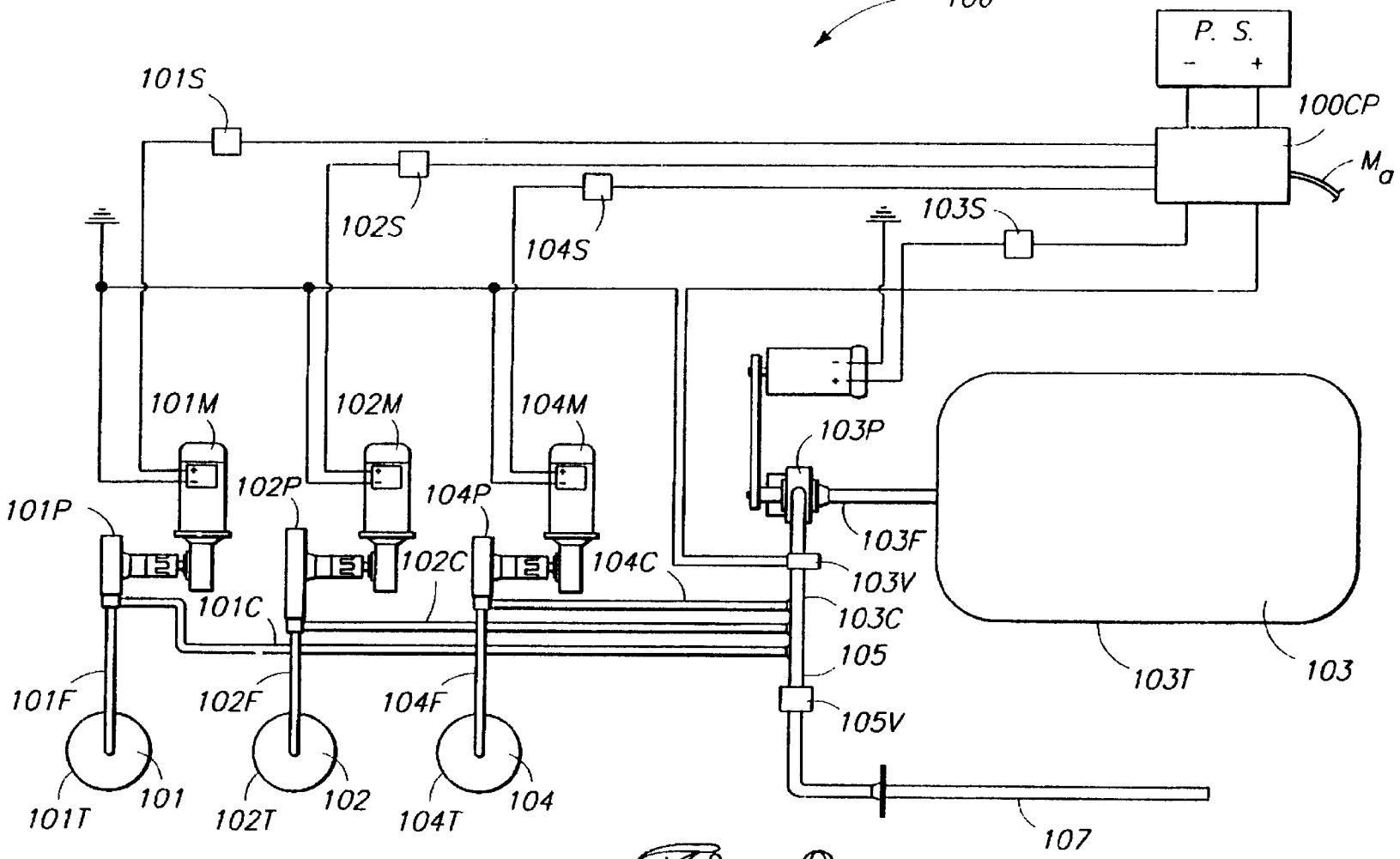
FIG. 8 is another schematic drawing of an impregnating accessory depicting three colorant feeds controlled by a control panel for regulating the amount of impregnating colorants admitted to the waste processing machine.
Figure 11:
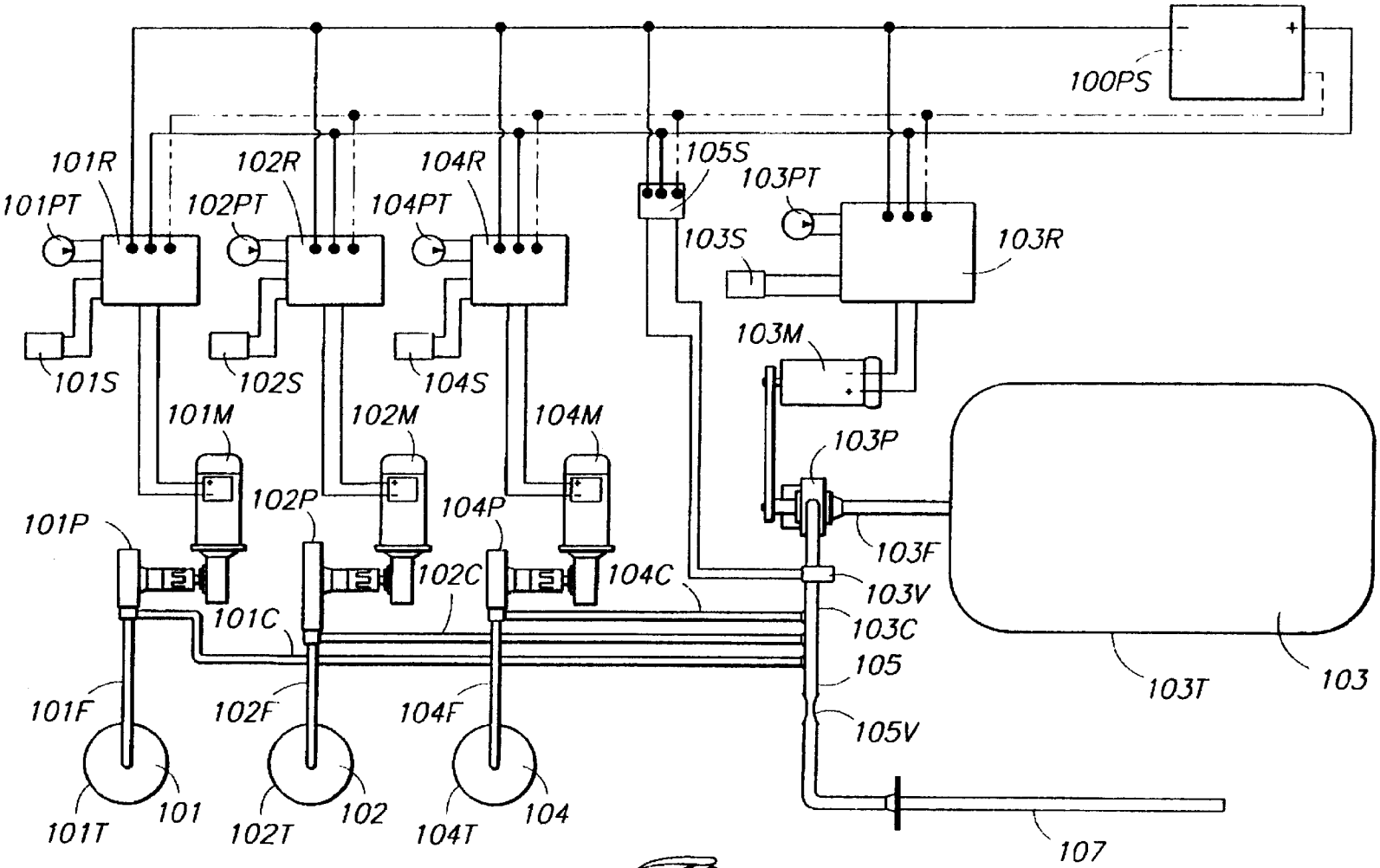
FIG. 11 depicts another schematic drawing of an impregnating accessory equipped to control the rate at which the impregnating agents are released into a fragmenting zone of the waste processing machine.

The present invention provides an impregnating accessory 100 particularly adapted for mounting and injecting the impregnating additives into the fragmenting zone 4 of waste recycling machines 1 equipped with a rotating and impacting rotor 40. Although machine 1 may be equipped with a single impregnating source or reservoir for applications requiring solitary treatment with a single impregnating agent, the accessory 100 may be suitably equipped to permit multiple injections of impregnating agents into the impregnating zone 4 as shown in FIGS. 3–8 and 11. The need for multiple impregnating source is exemplified by the use of accessory 100 to color waste materials. In the multiple impregnating agent source applications, the accessory 100 will advantageously include multiple impregnating agent sources such as at least two colorant reservoirs 101 and 102 and preferably at least three colorant sources 101, 102, and 104. An impregnating agent carrier, vehicle, or disperent source 103 (such as a water tank 103 equipped with water hose 103H connected to a water source), admixing means or site (generally enumerated as 105) for admixing the impregnating agent (e.g. colorant) and carrying vehicle (e.g. water) together. Mixing site 105 is simply shown as several intersecting feed or pipe lines feeding into a single or common pipe 105 which delivers the uniformily mixed colorants to a manifold assembly 107 which in turn uniformly distributes under constant pressure the aqueous colorant or impregnating agent to the fragmenting zone 4 through colorant injection lines 109. FIGS. 3, 8 and 11 show multiple tanks 101T, 102T and 104T which are utilized to serve as a colorant source for different basic colorants (101, 102 and 104) which, when admixed together at admixing site 105 provide the desired coloring effect. FIGS. 8 and 11 illustrate different arrangements for regulating the rate at which the impregnating agents are delivered to impacting zone 4. Each colorant tank (i.e. 101T, 102T and 104T) is operably connected to a feed pipe (101F, 102F and 104F) and colorizing draw pumps (101P, 102P and 103P) for drawing a monitored colorant amount from colorant tanks 101T, 102T and 104T. FIG. 8 depicts positive pressure hose pumps 101P, 102P, and 104P respectively powered by variable speed motors 101M, 102M, and 104M regulated by control panel 100PC preset to monitor a regulated amount feed of colorant 101, 102, and 104 upon activation or switching of switch 103S by power feeder 8. The impregnating accessory 100 equipped with a control panel 100PC as exemplified by FIG. 8 may be operationally connected to a power infeed load sensing switch, a colorizing control load sensing switch, a high r.p.m. adjusting screw set at 2180 r.p.m., a low r.p.m. adjusting screw set at 2100 r.p.m. and a load sensing toggle switch 100CP. Colorants pumped from colorant tanks 101T, 102T and 104T are pumped through colorant conduits 101C, 102C and 104C to a common mixing site 105 which furnishes water from water source 103.

The partial views of FIGS. 9 and 10 illustrate, more specifically, how a mechanical switch 103S including a control switch lever 103S and a switch contacting arm 8C attached to power feeder 8 may be utilized to switch the impregnating system. Contacting arm 8C is shown as protruding outwardly from power feeder 8 at a switch contacting position. For illustration purposes, contacting arm 8C connected to power feeder 8 serves to switch accessory 100. When the power feeder 8 rests in the idle or lowered position (e.g. without any waste 8 between feeder 8 and apron 9) as depicted in FIG. 10, switch contacting arm 8C depresses switching lever 103SL to the "off" switching position. As power feeder 8 encounters waste W and is operationally forced upwardly by waste W, power feeder 8 releases contacting arm 8C from contacting switch lever 103SL (as shown in FIG. 9) which in turn, switches 103S to the "on" position switching position. As previously mentioned, FIGS. 9 and 10 illustrate but one of many conventional switching means 103 which may be utilized to switch accessory 100. If desired, switch lever 103SL may be inserted onto frame 18 at a position so that a supportive arm carrying rotor 42 will directly switch switch 103S. If desired, variable electronic switches which detect the depth of waste feed W or amount of waste W fed to fragmenting zone 4 in coordination with variable pumps may be used to regulate the amount of impregnating agent pumped to impacting zone 4.

Water source 103 is commonly supplied by water tank 103T replenishment by a water supply to hose 103H for supplying water to admixing site 105 through water line conduit 103C. Water may be metered to the mixing site 105 by an in-line water pump 103P (e.g. a positive pressure hose pump 103P) powered by variable speed water pump motor 103M, a water control valve 103WC (e.g. a solenoid valve), and an electronic control valve 103V operationally connected to an electronic switching device 103S. Switch 103 is switched "on" upon movement of the contacting arm 8C of the power feeder 8 away from switch lever 103SL, which in turn, engages the control panel 100CP for engaging pump motors 101M, 102M, 103M, and 104M to pump controlled level of water and colorant to mixing site 105. Thus, when switch 103S is switched "on" by power feeder 8 due to the feeding of wastes at the fragmenting zone 4, power feeder 8 switches switch 103S and electronic valve 103V so as to activate water pump 103P to pump water from water tank 103T. As water is pumped to mixing joint 105, colorants 101, 102 and 104 from colorant tanks 101T, 102T and 104T are simultaneously siphoned or pumped at a regulated pumping rate and conducted through colorant conduits 101C, 102C and 104C to mixing joint 105 for admixing with water to provide a regulated and prescribed amount of an aqueous colorant for injection into the fragmenting zone 4. Thus, appropriate levels of water and colorants are respectively conducted through conduits 103C, 101C, 102C, and 104C for uniform admixing together at mixing site 105. The control panel 100CP may be conventionally equipped with a series of potentiometers or load sensors to measure or ascertain the rate of wastes W being fed to fragmenting zone 4 and to regulate the current flow and pumping rate of pump motors 101M, 102M, 103M, and 104M. The waste feed W rate may be appropriately determined with a potentiometer or load sensor (not shown) for sensing current draw upon electrical chord feed line $M_a$ of rotor motor MR and relaying the sensed reading to control panel 100PC which in turn controls the current feed to water motor pump 103M and concomitant pumping rate of water pump 103P. The control panel 100PC may be equipped with a series of potentiometers (as illustrated in FIG. 11) for relaying a preset or predetermined amount of current to colorant pump motors 101M, 102M, and 104M, which in turn regulate the respective pumping rates of colorant pumps 101P, 102P, and 104P.

The aqueous colorant and blend thus formed at mixing joint 105 is conducted by aqueous colorant output line 105E through ½ gate valves 105V onto manifold 107 which uniformly distributes the aqueous colorant under equalized pressure through ½ gate valves 109V onto manifold output injection lines 109 for uniform injection within fragmenting zone 4. Quick attachment QD assemblies 109QD permit the colorant accessory lines 109 to be readily detached from machine 1 when not in use and quickly reattached when in use. Quick attachments 109QD effectively alleviate potential problems of plugging of the injection ports of lines 109 with fragmented wastes D when the impregnating accessory 100 is not being used. FIGS. 4–7 depict in greater detail manifold 107 suitably equipped with exiting ports 107E for connection to injection lines 109. The appropriate number of exiting ports 107E and their placement or positioning within manifold 107 depends upon the size and particularly the cross-sectional size of the fragmenting zone 4. Lateral placement of the exiting ports 107E of manifold 107 at about four to about six inches apart will generally suffice for most impregnating processes. The impregnating agent is admitted to manifold 107 at manifold intake 107I. The manifold 107 is closed at the opposite end. Manifold mounting brackets 107B serve to mount manifold 107 upon shell 18 above the fragmenting zone 4.

As may be observed from FIGS. 3, 8, and 11, the impregnating accessory 100 may include an impregnating vehicle or carrier source 103 such as a water tank 103T or reservoir fitted with a water output line 103C connected, one or more impregnating agent reservoirs 101T, one or more impregnating agent feed conduits (e.g. 101F, 102F, 104F, etc.) equipped with at least two impregnating hose pumps 101P which may be run separately or together for feeding and mixing with the water flowing through the water output line 105 and regulating means for regulating an amount of aqueous impregnating agent delivered to the fragmenting zone 4.

The rate at which the impregnating agent is supplied to manifold 107 and injection lines 109 may be accomplished in a variety of different ways. For example, a photoelectric sensing and activating system as disclosed in U.S. Pat. No. 5,308,653 (e.g. see in particular FIG. 4 and Column 7, lines 20–56) may be used to regulate the impregnating agent delivered to the fragmenting zone 4 through injection lines 109. However, as previously mentioned, it is often desirable to use two or more colorant reservoirs ( e.g. 101T, 102T and 104T, etc.) in conjunction with two or more additive pumps (e.g. 101P, 102P and 104P) to deliver the colorants through colorant conduity (101C, 102C and 104C) to water mixing joint 105. It is also preferably to regulate the aqueous colorant or impregnating agent at an applicating rate so that it is directly responsive to the amount of material actually being processed within the fragmenting zone 4. FIG. 8 illustrates a manner in which a load sensing switch 103S operationally connected to a waste feed in cooperation with a control panel 100CP may be utilized so as to correlate the material W being fed by power feeder 8 and fragmented within the fragmenting zone 4 to a calibrated amount of impregnating agent based upon the waste W feed level. Thus, as wastes W are fed to the fragmenting zone 4, a load sensor 105S is operationally activated by the power feeder 8 and switched to engage a load sensor connected to $M_a$ which in turn triggers an electronic valve 103V to deliver a prescribed amount of aqueous colorant or other impregnating agents to the fragmenting zone 4. An effective means for controlling the colorant feed rate may be accomplished thuough a load sensor operationally connected to motor $M_R$ and amperage line $M_a$ so as to ascertain the amperage draw of the rotary motor $M_R$ and relay the reading via line $M_a$ to control panel 100CP which turn switches variable speed colorant pump motors (101M, 104M, and 102M) so as to draw the appropriate amount of colorants (101T, 104T and 102T) from colorant tanks 101T, 104T and 102T. The operational speed of variable speed pump motors 101M, 102M, and 104M as regulated by load sensing switch 105S and control panel 100CP monitors the colorant feed and permits a regulated amount of colorant to be atomized into the fragmenting zone 4. Since the rate of colorant injected into the fragmenting zone 4 is based upon the amount of wastes being processed within the fragmenting zone 4, uniformity in colorization or impregnation can be effectively regulated.

As illustrated by the drawings, fluidized impregnating reagents may be uniformly injected into the fragmenting zone 4 at a regulated or monitored rate. The impregnating accessory 100 generally includes pressurized flow means for controlling the impregnating reagent application flow rates and injecting means (107 and 109) for uniformly injecting the impregnating reagent onto the particulating product within the fragmenting zone 4. The aqueous colorant is admitted to the grinding chamber or fragmenting zone 4 through a plurality of aqueous injection lines 109 (usually 8–12 or more) as shown particularly by FIGS. 3, 5, and 7. The use of a plurality of injecting lines 109 with individual gate valves 109V results in uniform pressure and injection rates of the impregnating agent throughout the entire cross-sectional area of the fragmenting zone 4 which in turn creates a uniform coloration or impregnation of the recycled products D. The impregnating accessory 100 typically includes an electronically controlled valve 103V (e.g. a solenoid valve), a water output line 103C, a water pump 103P, a mixing site 105, two or more colorant concentrate reservoirs (e.g. 101T, 102T 104T, etc.) fitted separately with colorant injection pumps (e.g. 101P, 102P, 104P, etc.) colorant conduit lines (e.g. 101C, 102C and 104C) feeding into and admixing onto water within output line 105, and a manifold 107 fitted with a plurality of outlet ports 107E connected to injection lines 109 (shown as 12 injection lines 107 porting into the fragmenting chamber) for uniformly distributing and dispersing the aqueous colorant onto the waste particles confined within the impacting chamber of the fragmenting zone 4. It should be evident that equipping and simultaneous running of two or more pumps (e.g. 101P, 102P and 104P) as illustrated in the FIGS. 3, 8, and 11, permits the mixing of multiple colorants or other additives into a wider range of possible colors or compounding.

Electronic control valve 103V may be used to regulate the flow rate of aqueous colorant to the fragmenting zone 4. As previously mentioned, the electronic control valve 103V is preferably activated by the movement of the power feeder 8 and by a load sensing switch 105S operationally connected to the accessory 100. As wastes W or other cellulosic materials are fed to the fragmenting zone 4, the load sensing switch 105S may be used to activate an electronic control valve 103V to increase the flow rate of aqueous impregnating additives to manifold 107. By this means, water and liquid additive may be combined and injected into the grinding chamber or fragmenting zone 4 at a more precise and controlled injection rate. This results in substantial savings while also contributing to more uniform colorization and intensity or impregnation of the processed product D.

As shown in FIGS. 8 and 11, each colorant arrangement (i.e. 101, 102, and 104) may be suitably equipped with a switch (i.e. 101S, 102S, and 104S) so as to separately permit the switching of each colorant motor 101M, 102M, and 104M. Colorant motor switches 101S, 102S, and 104S may be connected in series with water switch 105S and placed in the "on" switching position so that when switch 103S is activated by the feeding of material W to fragmenting zone 4, then the circuitry for colorant motors 101M, 102M, and 104M is closed for operation so as to permit the pumping of prescribed amounts of colorant 101, 102, and 104 from the colorant tanks (i.e. 101T, 102T, and 104T) for admixture with water pumped from tank 103T.

FIG. 11 depicts a schematic representation of accessory 100 adapted to operate from a direct current power source 100PS such as a 24 volt battery. This arrangement may be utilized in machines 1 powered by combustion engines instead of the electrical motor and as depicted by the Figures. As may be observed, FIG. 11 commencing with variable speed motors 101M, 102M, 104M, and 103M to the manifold 107 is essentially the same schematic representation as depicted by the AC current operated accessory 100 shown in FIG. 8. Each of the DC colorant motors (i.e. 101M, 102M, and 104M) depicted in FIG. 11 receives a preset and regulated current feed which runs each motor at a predetermined or preset speed. In operational use, potentiometers 101PT, 102PT, and 104PT are preset so as to provide the desired colorant mix to mixing site 105 which regulate the current flow or voltage flowing from variable frequency drive or variable speed regulates 101R, 102R, and 104R respectively to colorant motors 101M, 102M, and 104M water pump motor 103M so as to respectively control the pumping fluid rate of pumps 101P, 102P, 103P, and 104P. Variations in coloring schemes may easily effectuated by presetting each of the color monitor potentiometers (i.e. 101PT, 102PT, and 104PT) to the desired colorant blend for injection into the fragmenting zone 4.

The phantom or broken lines of FIG. 11 illustrate modifications for converting the depicted battery power 100PS system to a three phase AC current 100PS system. The power source 100PS may be derived from any conventional AC power outlet. The modifications to the battery powered system generally include a three phase wiring scheme as illustrated by the phantom lines. Each of the paired potentiometers and variable speed regulators (i.e. 101PT, and 101R, 102PT, and 102R, 104PT and 104R, 103PT and 103R) are combined into a digitalized and controlled pairing of variable frequency drive or adjustable speed drive equipped with a digital electronic control provided by a commercially available TOFVERT model VFS7 (often paired with motor) manufactured and distributed by TOSHIBA Corporation, 13131 West Little York Road, Houston, Tex., 77041.

In essence, the digitalized electronic units function similar to the battery powered system of FIG. 11 by affording a preset and controlled colorant feed rate. Either system provides a predetermined or preset amount of colorant and water for admixture and injection into the fragmenting zone 4 by regulating the pumping rate. As evident from the aforementioned, a variety of regulating means may be effectively utilized to monitor and control the rate at which multiple impregnating agents are combined with one another, and if desired, combined with a carrying vehicle or solvent (i.e. water) for delivery to the impacting zone 4. Illustratively, pressurized systems electronically controlled by mechanical or electronic valves (in cooperation with or without load sensing devices for sensing the material waste W feed) for regulating the impregnating agent application rate may be effectively adapted to the impregnating accessory 100.

The impregnating process and impregnating accessory 100 may be generally applied to a broad range of chemical impregnating agents. The impregnating process affords an effective means for injecting into the impregnating zone 4 a relatively low concentration of impregnating agents at a high solids ratio of cellulosic materials to impregnating agent while also reducing the carrier or vehicle requirements. Although liquid carried impregnating agents are illustrated by the Figures, solid (as well as liquid-carried or liquid-impregnating agents), may be applied to the impregnating machine and the processing thereof. If desired gaseous impregnating agents may also be injected into the impregnating zone 4 and impregnated onto the waste materials W. When powdered impregnating agents are used, solid metering devices may be used to meter the appropriate impregnating agent to fragmenting zone 4. Consequently, the process provides a particularly effective method for uniformly incorporating and dispensing an impregnating agent throughout a cellulosic mass irrespective of the physical form of the impregnating agent. Since the impregnating process operates at a relatively low vehicle-to-dry-mass ratio, it is generally unnecessary to dry or evaporate the vehicle or carrier from the processed product.

The process may be adapted to any cellulosic product in a particulated or comminuted form impregnated with an impregnating agent while concurrently comminuting the cellulosic material to the desired product size. A broad range of diverse impregnating agents yielding a host of different processed impregnated cellulosic materials D may be effectively produced by the present process. For example, binding agents (e.g. plastics, thermosets, etc.) may be conveniently incorporated and impregnated into particulated paper, wood chips or fibers and the resultant impregnated product may be compressed or adhesively molded into a desired molded plasticized paper or plasticized wood product. Illustrative binding or film forming impregnating agents in the manufacture of such products bound together within a plastic material include a host of aqueous colloidal dispersions of polymers derived from the polymerization of monomers such as acrylic acid, methoacrylic acid, methyl methacrylate, ethyl methacrylate, ethyl-hexyl-acrylate, tetrafluoroethylene, chlorotrifluoroethylene, vinylidene fluoride, butadiene-1,3, isoprene, chloroprene, styrene, nitrites, acrylamide, vinyl alcohol, methacrylamide, acrylonitrile, vinyl chloride, vinyl acetate, vinylidene chloride, ethylene, propylene and isobutylene; drying oil fatty acid compounds such as tuna oil, linseed oil, soybean oils, dehydrated castor oil, cottonseed oil, poppyseed oil, safflower oil and sunflower oil; fatty acids derived from drying oils; partially polymerizates of drying oils such as partially polymerized linseed oil; oxidized drying oils such as oxidized soybean oil, synthetic drying oils obtained by the esterification of fatty acids with polyhydric alcohol (e.g. glycerol pentaerythritol, mannitol and sorbitol); drying oil-alkyl resins such as are obtained by the reaction of fatty acid drying oils with polyhydric alcohol and a polycarboxylic acid such as maleic anhydride, fumaric acid, phthalic acid, adipic acid, sebacic acid, etc.; lattices of chlorinated and natural rubbers, the polysulfides, epoxides, amino resins such as ureaformaldehyde, melamine-formaldehyde, nitrocellulose, ethyl cellulose, cellulose butyrate, chlorinated polyethers, terpene resins, chlorosulfonated polyethylene, natural rubber, organosiloxane polymers, and various other binding agents and film forming binders.

The vehicle or carrier for liquid dispensable impregnating agents, may be any compatible vehicle which serves as a carrier or dilutent for the impregnating agent. Vehicle or dispersant requirements may be significantly reduced due to the efficacy of the processing conditions. This can result in substantial drying or evaporation costs savings such as typically encountered when there exists a need to dry excessively wet products to the finished dry form. Although flammable carriers may serve as a solvent or dilutent for lipophilic impregnating agents, the more volatile and flammable vehicles may be more safely and effectively replaced with the less volatile and less flammable lipophilic vehicles (e.g. oil carriers, heavy hydrocarbons, etc.) The preferred means for uniformly injecting the impregnating agent into the fragmenting chamber 4 comprises a liquid or an aqueous dispersion or solution of impregnating agents. Water constitutes a preferred carrier or vehicle for diluting and carrying liquid dispersible impregnating agents to the fragmenting zone 4. The water may function as a solvent for those impregnating agents which are partially or fully miscible with water. For certain impregnating agents, the impregnating agent may be colloidally suspended or dispersed in the water carrier. Emulsifying techniques using conventional emulsifiers or surfactants to emulsify water-insoluble or lipophilic impregnating agents into an aqueous emulsion may also be effectively utilized to place insoluble impregnating agents in a suitable form for dispersal in an aqueous carrier and injected into impregnating zone 4.

As previously mentioned, the impregnating process is particularly well suited to colorizing cellulosic materials. The colorizing process may be effectively utilized to provide a broad spectrum of colored cellulosic products and coloring agents. The color impregnating agents may, accordingly, be selected from a broad range of color pigments and dyes to provide a vast array of colored products. The color impregnating agents include the colored agents as well as white colorants with or without mineral products used as fillers and extenders. Various coloring agents may be blended together with the multiple colorant mixing system of this invention to provide the desired coloring effect. Illustrative coloring agents include the various water soluble and insoluble organic and inorganic pigments and dyes such as titanium dioxide, zinc oxide, phthalocyanine blue and green, lead chromate, molybdate orange, zinc sulfide, calcium sulfate, barium sulfate (barytes), clay, mica, calcium carbonate (whiting), silica, benzylidene yellow, cadmium yellow, toluidine toners, sienna, amber, ultramarine blues, chromium oxides, carbon black, antimony oxide, magnesium silicate (talc), aluminum silicate, lead silicate, graphite, aluminum oxide, calcium silicate, diatamaceous silica, limonite, hematite, magnetite, siderite, selenium sulfides, calcined nickel titanate dioxide, molybdate oranges, chrome green, iron bluides, benzidine yellows and oranges, iron salts of nitroso compounds, Hanso yellows, Di-nitraniline oranges, permanent red 2B types in various combinations thereof and the like. Pigment dispersants such as tetrasodium pyrophosphate, lecithin, gum arabic, sodium silicate, the various water soluble soaps, the aliphatic and aromatic sulfonates sulfolignins, the aliphatic sulfates, various polyethers and ether-alcohol concentrates and the like may be added to enhance the aqueous dispersion of the pigments.

Auxiliary coloring components such as protective colloids or thickeners such as sodium carboxymethylcellulose, sodium and ammonium polyacrylate, gum karaya, sodium aliginate, methyl cellulose, hydroxyethyl cellulose, polyvinyl alcohol, starch, casein, soybean protein and gelatin; freeze-thaw stabilizers such as ethylene glycol, propylene glycol, glycol ethers, polysubstituted phenolates, modified glyceryl monoricinoleate, urea, thiourea, etc.; defoamers such as kerosene, pine oil, octyl alcohol, tributyl phosphate, phenyl mercuric acetate, etc.; buffers such as some of the protective colloids, sodium bicarbonate, sodium tetraborate and the like; coalescing agents such as "Carbitol," "Carbitol Acetate," hexylene glycol, "Butyl Cellosolve Acetate," and "Butyl Carbitol Acetate"; antirust agents like sodium benzoate; dryers for unsaturated polymers, oils, and alkyds, oil modified epoxides and polymeric butadienes, etc. (e.g. benzoyl peroxide, ferric tris 2,4-pentanedionate, chromium pentanedionate, the manganese, cobalt and lead naphthenates and the corresponding 2-ethylhexonates thereof) may also be incorporated into the coloring agent stream.

Commonly available colorant agent concentrates comprised of carbon black and iron oxide blended at a rate of about 0.25 to about 10 percent (preferably at about 0.5 percent to about 0.6 percent) volume concentrate per 10 water volumes provide a particularly effective color impregnating agent in the manufacture of colored wood mulches. If desired, bacteriocides and fungicides such as the halogenated acetylene alcohols, diphenylmercuric dodecenyl succinate, o-phenylphenol and the sodium salt thereof, the trichlorophenols and the sodium salts thereof, and the like may also be utilized as impregnating agents to protect the processed cellulosic product D from bacteriological degradation. If a brightly red colored mulch is desired, iron oxide may be used as the colorant.

The fragmenting and impacting process may be applied to liquid as well as gaseous and the solid or powdered impregnating agents. The process generally entails incorporating a sufficient amount of the impregnating agent to create the desired end product. If particle size of the processed product is important, the fragmenting zone and screens may be adjusted and operated so as to produce the desired end product. In coloring products, the colorant concentrations and colorant types may be suitably adjusted so as to yield the desired end product.

The fragmenting and impregnating process is highly effective for processing of large volumes or tonnage of wastes or cellulosic source materials to the desired impregnated and particulated product. For example, the process may be effectively applied to the manufacture of aspen waferboard blended with phenolic resins treated with disodium octaborate tetrahydrate to protect the waferboard from termite infestation as disclosed in the *Forest Product Journal,* Vol. 44, No. 9 on pages 33–36 by Timothy G. Myles. The impregnating process in such a manufacture can serve multiple impregnating purposes in that the binding agent for molding of the bonded product as well as the termite killing agent may be impregnated into the particulated cellulosic product while it is being fragmented to the desired particle size for molding. Similarily, a color impregnating agent and an insecticide such as the disodium octaborate tetrahydrate (DOT) may be combined and added in effective amounts to the fragmenting zone to create a colored mulch baited with a lethal level of termite killing DOT so as to effectively attract and kill termite infestation. The impregnating process is particularly attractive since large volumes of material may be processed to yield a superior and attractive termite killing bait. Thus, the impregnating process may be effectively used to impregnate multiple impregnating agents into a cellulosic product in a single pass.

Further information regarding the accessory 100 and means for controlling impregnating rates may be obtained by referring to captioned provisional application 60/082,481.

What is claimed is:

1. A method for impregnating waste materials with an impregnating agent while concurrently impregnating, suspending, and fragmenting the waste materials in a turbulent fragmenting zone, said method comprising:

a) feeding a waste feed of the waste materials to the turbulent fragmenting zone;

b) uniformly injecting the impregnating agent onto the waste materials while suspending the waste materials within the fragmenting zone;

c) particulating the waste feed to a particulated product by fragmenting and impacting the waste materials within said turbulent fragmenting zone;

d) uniformly impregnating the particulated product with said impregnating agent within said turbulent fragmenting zone so as to provide a uniformly impregnated particulated product;

e) screening the impregnated particulated product to further fragment said product to a desired particle size; and f) recovering the uniformly impregnated particulated product of the desired particle size from said fragmenting zone.

2. The method according to claim 1 wherein the impregnating agent comprises a coloring agent.

3. The method according to claim 1 wherein the impregnating includes monitoring the waste feed fed to the fragmenting zone with a load sensing switch and activating the injecting of the impregnating agent to the fragmenting zone at a monitored rate with said load sensing switch.

4. The method according to claim 3 wherein the impregnating agent comprises a coloring agent.

5. The method according to claim 3 wherein the method includes the blending together of two different coloring agents obtained from separate colorant sources at the monitored rate to yield the impregnated particulated product of a desired color.

6. The method according to claim 3 wherein a coloring agent and water are blended together at the monitored rate to provide an aqueous colorant for the injecting of the impregnating agent onto the waste feed within the fragmenting zone.

7. The method according to claim 1 wherein the feeding of the waste feed consists essentially of the feeding of a cellulosic waste material as the waste feed to the fragmenting zone.

8. The method according to claim 7 wherein the uniformity impregnating includes the impregnating of the cellulosic waste material with a pesticide.

9. The method according to claim 8 wherein the impregnating with the pesticide includes a termiticide.

10. The method according to claim 1 wherein the method includes monitoring the waste feed fed to the fragmenting zone with an electronic load sensor and responsively relaying an electronic signal detected by the load sensor to a plurality of impregnating agent pumps so as to activate the pumps to uniformity inject a regulated amount of the impregnating agent into the fragmenting zone.

11. The method according to claim 10 wherein the plurality of impregnating pumps the regulated amount of impregnating agent from multiple impregnating agent sources to a mixing site for admixing with a prescribed amount of water to provide an aqueous impregnating agent stream.

12. The method according to claim 11 wherein the stream is conducted to a manifold equipped with a plurality of outlet ports for the uniformity injecting the impregnating agent onto the waste feed.

13. The method according to claim 12 wherein the multiple impregnating agent sources comprises multiple color sources pumped at the regulated amount for the admixing with the prescribed amount of water.

14. The method according to claim 13 wherein a uniform pressure of the aqueous stream exiting the outlet ports is maintained so as to permit the uniformity injecting of the aqueous stream onto the fragmenting zone.

15. The method according to claim 14 wherein the outlet ports are positioned at an elevated position so as to permit gravitational injections of the aqueous streams to the fragmenting zone.

16. A waste fragmenting and impregnating machine equipped to concurrently uniformly impregnate and fragment a waste material with an impregnating agent within a turbulent fragmenting zone, said machine comprising:

a) feeding means for feeding the waste materials to the machine;

b) an enclosed turbulent fragmenting zone for fragmenting the waste materials to a particulated product;

c) injection means for injecting and uniformly distributing the impregnating agent within the fragmenting zone while turbulently fragmenting and impregnating the particulated product within the turbulent fragmenting zone;

d) a screen for grating and screening the particulated product to a predetermined particle size; and e) recovering means for recovering the particulated impregnated product of the predetermined size from said turbulent fragmenting zone.

17. The machine according to claim 16 wherein the injection means includes a manifold equipped with a multiplicity of injection lines laterally positioned apart and accessing in a spacial relationship to the fragmenting zone so as to uniformly distribute the impregnating agent within the fragmenting zone.

18. The machine according to claim 17 wherein the machine includes a water source and an impregnating agent source and a mixing site for admixing water from the water source together with the impregnating agent from the impregnating source.

19. The machine according to claim 18 wherein the impregnating source includes at least one reservoir for containing the impregnating source.

20. The machine according to claim 17 wherein the injective means comprises an impregnating accessory equipped with multiple reservoirs for multiple impregnating agents and a liquid carrier for the impregnating agents regulators, and regulated pumps for pumping the impregnating agents and the water to an aqueous admixing site.

* * * * *